US005673836A

United States Patent [19]

Bush

[11] Patent Number: 5,673,836

[45] Date of Patent: Oct. 7, 1997

[54] MODULAR COMPARTMENTALIZED OUTDOOR APPAREL

[76] Inventor: Steven Roy Bush, 245 Bush St., Hulett, Wyo. 82720

[21] Appl. No.: 548,958

[22] Filed: Oct. 27, 1995

[51] Int. Cl.[6] ..... A41D 13/00

[52] U.S. Cl. ..... 224/576; 2/94; 224/582; 224/583

[58] Field of Search ..... 224/576, 151, 224/153, 581–3, 602, 605, 606; 2/94

[56] References Cited

U.S. PATENT DOCUMENTS

| | | | |
|---|---|---|---|
| Re. 34,474 | 12/1993 | Lutz . | |
| Re. 34,661 | 7/1994 | Grim . | |
| 2,248,455 | 7/1941 | Freund | 2/94 |
| 2,620,479 | 12/1952 | Buck | 2/94 |
| 2,717,391 | 9/1955 | Bracken | 2/94 |
| 2,948,898 | 8/1960 | Allen | 2/94 |
| 4,272,852 | 6/1981 | Bell | 2/94 |
| 4,622,697 | 11/1986 | Tajima . | |
| 4,778,706 | 10/1988 | Katz . | |
| 5,095,544 | 3/1992 | Elverskog . | |
| 5,375,262 | 12/1994 | Carter . | |

FOREIGN PATENT DOCUMENTS

| | | |
|---|---|---|
| 26 41 215 A1 | 3/1978 | Germany . |
| 56689 | 6/1944 | Netherlands . |
| 2 226 943 | 7/1990 | United Kingdom . |

*Primary Examiner*—Renee S. Leubke
*Attorney, Agent, or Firm*—Richard C. Litman

[57] ABSTRACT

An apparel system which allows easy access to storage means provided on the front panels of the vest forming part of the apparel system. The storage means includes various pockets, and elastic straps sewn to the front panels of the vest which act as holders for ammunition and hunting calls. A removable back panel allows the harness from a backpack to pass to the inside of the vest, thus preventing the harness from interfering with the wearer's access to the storage means on the front panels of the vest. The apparel system also includes other components including gaiters, mittens, fanny pack, and short chaps, also known as chinks. A rifle sling which allows a rifle to be carried horizontally and a one man shelter which stores in the fanny pack, are also included as part of the apparel system.

13 Claims, 9 Drawing Sheets

MODULAR COMPARTMENTALIZED OUTDOOR APPAREL

BACKGROUND OF THE INVENTION

1. Field of the Invention

The present invention relates generally to outdoor apparel, and more particularly to modular apparel which is adaptable to a variety of weather conditions and is compartmentalized to allow ready access to various equipment by the wearer.

2. Description of the Prior Art

Outdoor enthusiasts such as hunters, campers, hikers, bird watchers, etc., have to carry a large amount of equipment such as camping gear, food, water, binoculars, calls, ammunition, maps, compass, knife, etc., with them at all times. Further, because outdoor temperatures fluctuate widely in the course of the day, clothing necessary to keep a person adequately warm in the early morning hours, will be too hot at mid-day. Therefore, a need exists for outdoor apparel which has a large amount of storage space organized to allow ready access, by the wearer of the apparel, to various pieces of equipment. In addition, the outdoor apparel should be adjustable in the level of warmth it provides the wearer. Clothing that can be reconfigured to provide less warmth, and clothing which provides protection to the wearer are known in the prior art. However, none of the prior art teaches or suggests the combination of organized storage space and reconfigurable design provided by the present invention.

U.S. Pat. No. 4,622,697, issued to Tajima, shows overalls for use by skiers, which have detachable protectors for the lower leg, i.e. the area below the knee. Tajima does not teach or suggest the combination of organized storage space and reconfigurable design provided by the present invention.

U.S. Pat. No. 4,778,706, issued to Katz, shows a type of canvas suitable for needlepoint applications. Katz does not suggest a garment resembling the present invention.

U.S. Pat. No. 5,095,544, issued to Elverskog, shows protective chaps for use by chain saw operators to protect their legs from the chain saw. Elverskog does not teach or suggest the combination of organized storage space and reconfigurable design provided by the present invention.

U.S. Pat. No. 5,375,262, issued to Carter, shows a pair of chaps fastened around the legs using VELCRO® fasteners. Carter does not teach or suggest the combination of organized storage space and reconfigurable design provided by the present invention.

Reissue U.S. Pat. No. 34,474, issued to Lutz, shows a hand carried utility bag which can be converted to a bicycle saddle bag. Lutz does not teach or suggest the combination of organized storage space and reconfigurable design provided by the present invention.

Reissue U.S. Pat. No. Re. 34,661, issued to Grim, shows an ankle brace for wearing under the shoe. Grim does not teach or suggest the combination of organized storage space and reconfigurable design provided by the present invention.

British Patent Document Number 2 226 943 A, by Frith et al., shows protective chaps for use by chain saw operators to protect their legs from the chain saw. Frith et al. do not teach or suggest the combination of organized storage space and reconfigurable design provided by the present invention.

German Patent Document Number 26 41 215 A1, by Hinterleitner, shows pants and a jacket having zippers extending along the legs and the arms, respectively. The zippers along the legs and the arms can be opened or closed to configure the garment of Hinterleitner for varying temperatures. Hinterleitner does not teach or suggest the combination of organized storage space and reconfigurable design provided by the present invention.

Netherlands Patent Document Number 56689, by Van Solt, shows a leg protector that ties around the upper thigh, below the knee, the ankle and the arch of the foot. Van Solt does not teach or suggest the combination of organized storage space and reconfigurable design provided by the present invention.

None of the above inventions and patents, taken either singly or in combination, is seen to describe the instant invention as claimed.

SUMMARY OF THE INVENTION

The present invention, in its broadest aspect, is directed to an apparel system which allows easy access to storage means provided on the front panels of the vest forming part of the apparel system. The storage means includes various pockets and elastic straps sewn to the front panels which act as holders for ammunition and hunting calls. A removable back panel allows the harness from a backpack to pass to the inside of the vest, thus preventing the harness from interfering with the wearer's access to the storage means on the front panels of the vest. The apparel system also includes other components including gaiters, mittens, fanny pack, and short chaps, also known as chinks. A rifle sling which allows a rifle to be carried horizontally and a one man shelter which stores in the fanny pack, are also included as part of the apparel system.

Accordingly, it is a principal object of the invention to provide apparel that provides ample storage for a variety of equipment needed by the wearer.

It is another object of the invention to provide a garment that allows ready access by the wearer to equipment carried in and/or on the garment.

It is a further object of the invention to provide a garment that allows the harness from a backpack to pass to the inside of the garment thereby preventing the harness from interfering with the wearer's access to items carried on the front panels of the garment.

Still another object of the invention is to provide a garment which allows the belt of a fanny pack to pass to the inside of the garment thereby preventing the belt from interfering with the wearer's access to items carried on the front panels of the garment.

Still another object of the invention is to provide gaiters which can be used with any type of boot, including cowboy boots which do not have laces.

Still another object of the invention is to provide canvas chinks which protect the wearer's legs.

Still another object of the invention is to provide a gun sling which allows the gun to be carried across the user's chest in a horizontal orientation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to an apparel system useful for hunters and outdoors enthusiasts. However, many people engaged in other activities may also benefit from the apparel system of the present invention. These persons include ranchers, cement workers, snowmobilers, workers stacking hay, sawmill workers, hikers, black smiths, carpenters, cyclists, construction workers, roofers, mechanics, loggers, and horseback riders.

Outdoors enthusiasts often have to spend long periods of time in the wilderness where they do not have access to sources of food and other essential supplies. Therefore most outdoor enthusiasts have to pack all the necessary supplies with them. In addition, because the outdoors enthusiast often spends the entire day outdoors, he or she is often exposed to sudden changes in climatic conditions. Therefore, the outdoors enthusiast requires apparel that allow him or her to carry all his or her gear and supplies, while allowing the outdoors enthusiast to quickly and easily adjust the level of protection against the elements offered by his or her apparel.

Further, hunters in particular, need apparel that organizes their gear and supplies in a manner such that the gear and supplies will be readily and easily accessible by the hunter. Ready access to gear and supplies is critical to the hunter because he or she often has only seconds to react when he or she happens upon game animals. For the hunter therefore, hunting success often hinges upon ready access to items such as ammunition, binoculars, calls, knife, and his or her firearm.

To organize the supplies and gear needed by the hunter or outdoors enthusiast, and to allow easy and quick adjustment of the level of protection against the elements provided by the hunter's or outdoors enthusiast's apparel, the apparel system of the present invention was developed. The apparel system of the present invention is in the form of a kit including an organizer upper body outer wear which is convertible between a vest and a coat, a small portable shelter, a backpack attachable to the vest/coat, a fanny pack, gaiters, mittens, canvas chinks and a sling that can hold a firearm such as a rifle or shotgun in a horizontal position across the chest of the wearer. The parts of the kit may be sold together or separately.

Throughout the following description left and right refer to the left and right of the wearer of the apparel.

Figure 1:
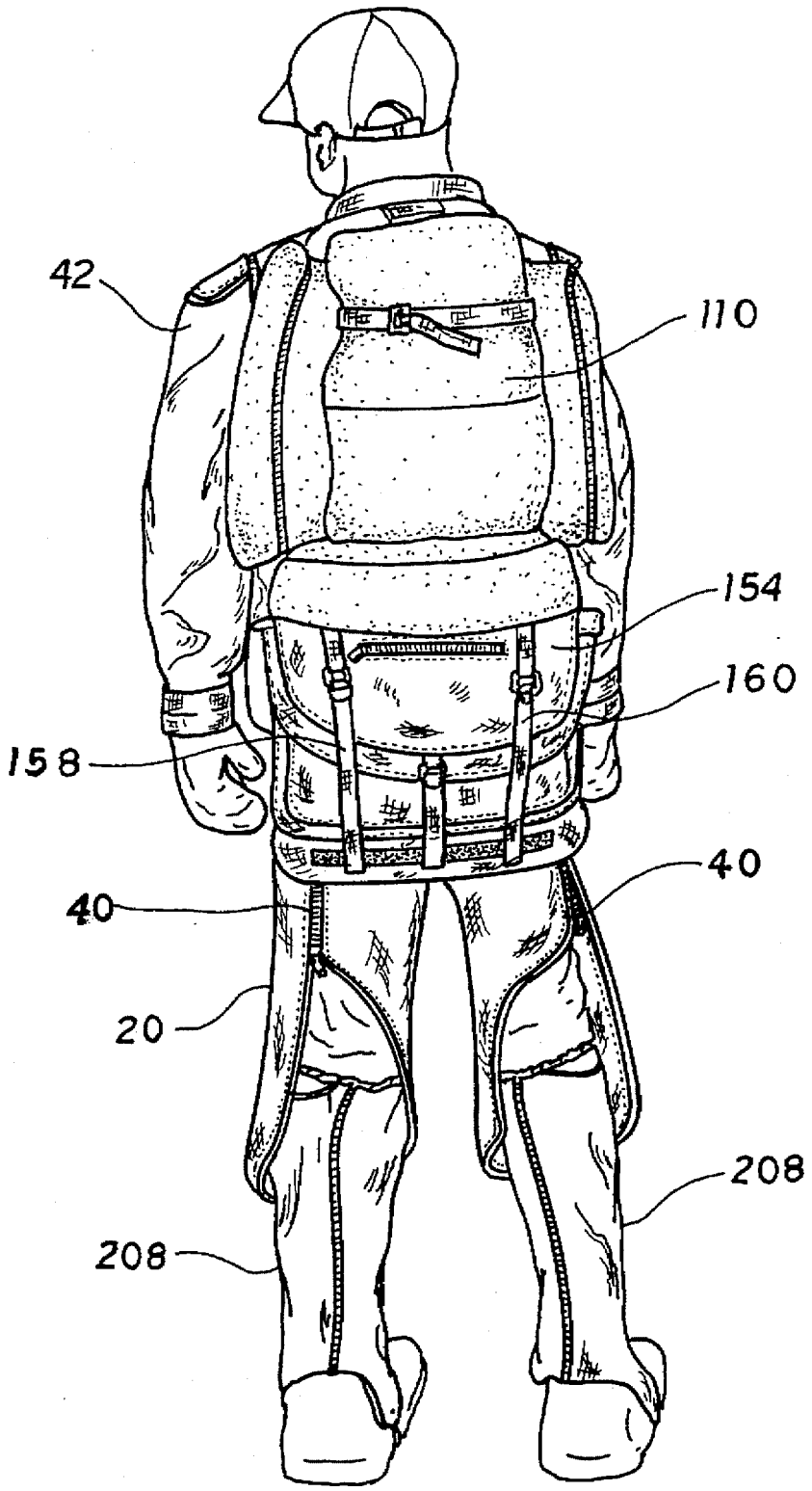
FIG. 1 is an environmental perspective view showing a person wearing the apparel of the present invention.
Figure 2:
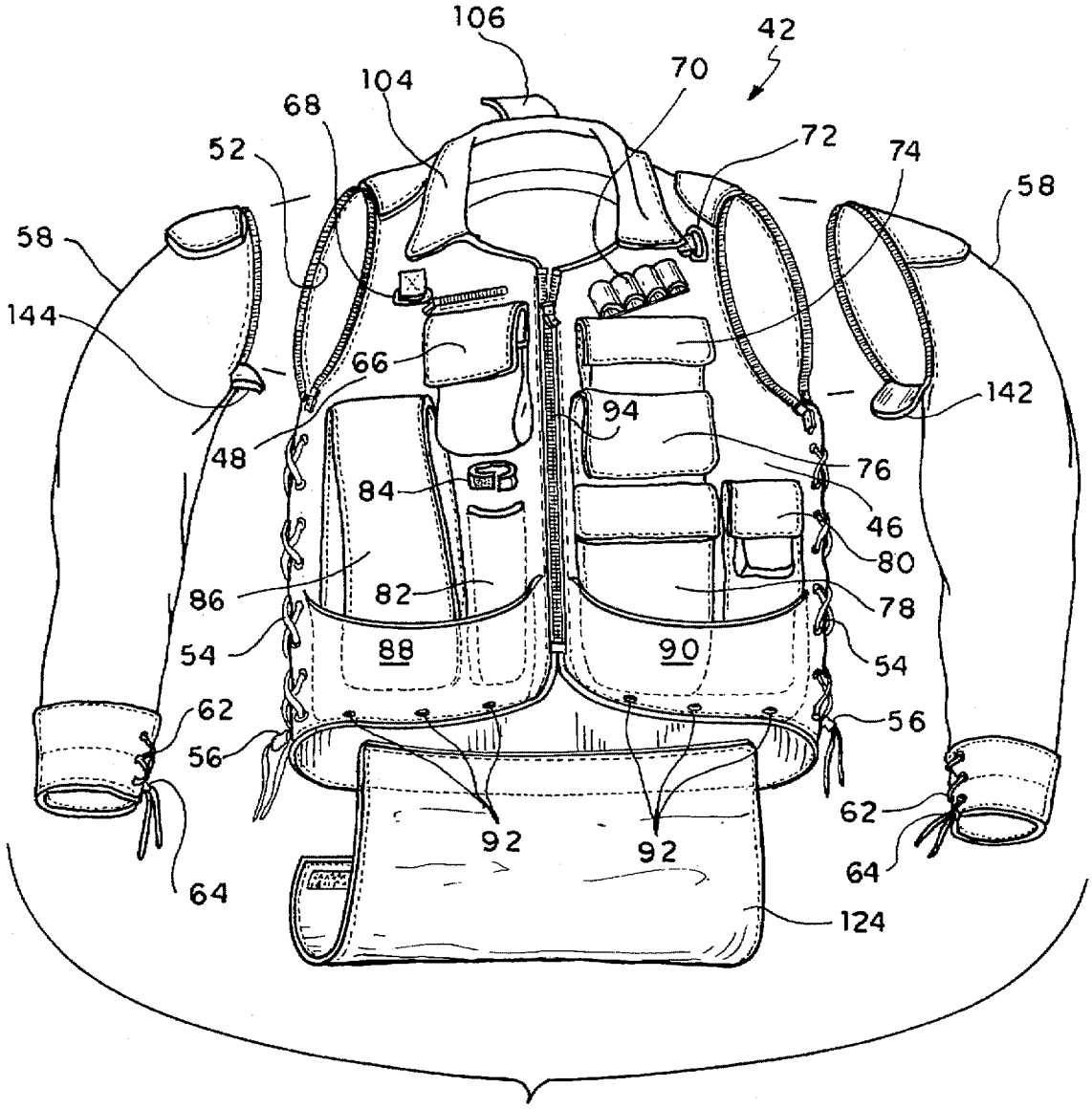
FIG. 2 is a front view of the vest of the present invention showing the storage facilities on the front panels of the vest and the detachable sleeves.
Figure 5:
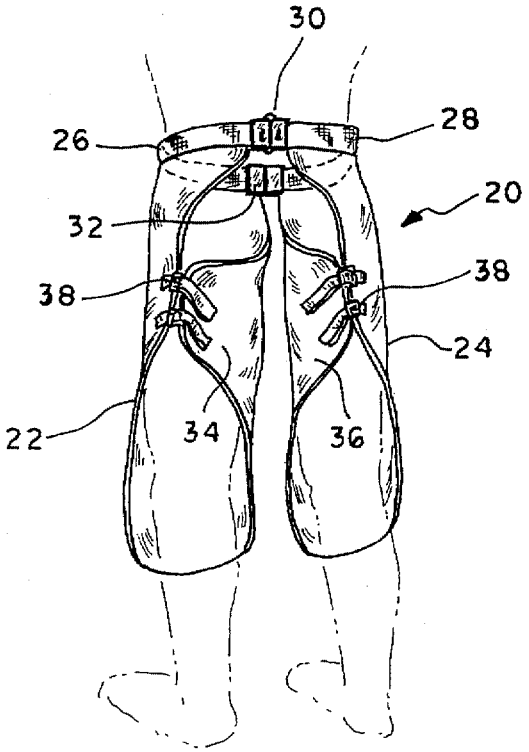
FIG. 5 is an environmental perspective of the short chaps, also known as chinks, of the present invention.
Figure 6:
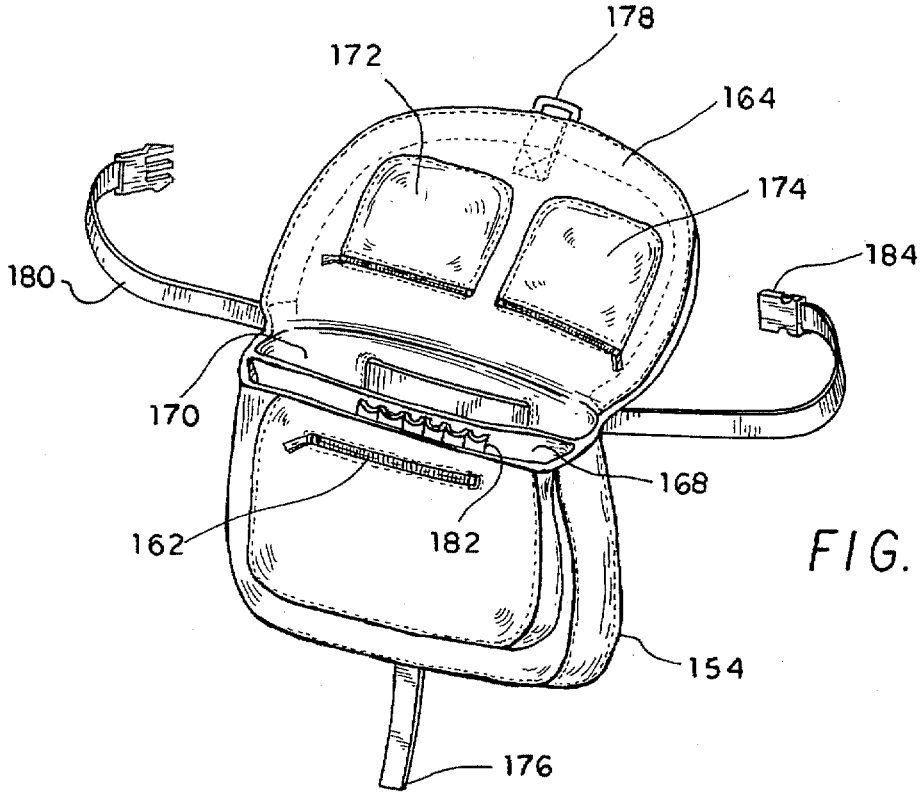
FIG. 6 is a perspective view showing the fanny pack of the present invention with the lid open.
Figure 7:
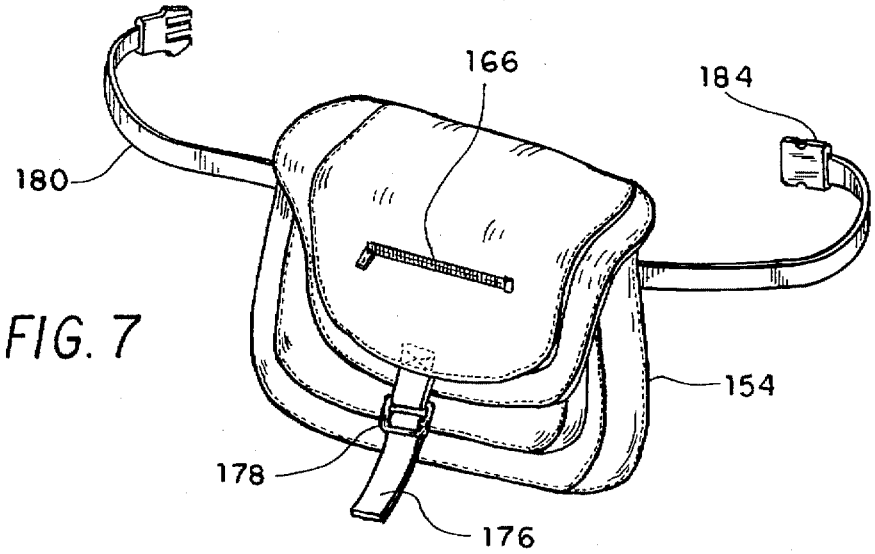
FIG. 7 is a perspective view showing the fanny pack of the present invention with the lid closed.

Referring to FIGS. 1, and 5, the canvas chinks 20 that form part of the apparel system of the present invention are shown. Chinks are chaps that extend from the waist to about the midpoint of the shins. Prior art chinks are made of leather. Leather has a tendency to soak up water when worn in the rain. Rain-soaked leather chinks are heavy and make the wearer's movements cumbersome. Also rain soaking through the leather causes the wearer's pants and legs to become wet.

Chinks 20 include left and right canvas panels 22 and 24 respectively. Each panel extends from the waist to anywhere within an area beginning just below the knee to about the midpoint of the shin. The top of each panel carries a strap of nylon webbing 26 and 28. The nylon straps are connected at the back by D-ring 30. The straps 26 and 28 are releasably connected at the front by buckle 32, to fasten chinks 20 about the wearer's waist.

It is preferable that the lengths of straps 26 and 28 be adjustable at both the front and the rear. This feature would allow the panels 22 and 24 to be properly positioned about the waist so as to cover the front of each leg, irrespective of the wearer's size.

The panels 22 and 24 have extensions 34 and 36, respectively. Extensions 34 and 36 wrap around the insides and the backs of the thighs, and are fastened to the outer edges of panels 22 and 24 using buckles 38 to secure the panels 22 and 24 about the legs of the wearer. Alternatively, the extensions 34 and 36 may be fastened to the outer edges of panels 22 and 24 using zippers 40 as shown in FIG. 1.

Chinks 20 are made of 12 oz. waterproof and mildew-proof canvas. They are sewn with nylon thread, then glued around the seams and straps. They also are a natural color which provides excellent camouflage for hunting.

Chinks 20 are lightweight, but protect the legs from branches, thistles, insects, bushes, snake bite, etc. Chinks 20 also provide excellent protection for the wearer's knees when kneeling. Chinks 20 are designed for one size to fit adult wearers of almost all sizes. Chinks 20 can also be made in a children's size. The chinks 20 are cooler than leather, and warmer than just wearing pants alone. Further, the chinks 20 protect the pants from thorns and branches which could fray the fabric, thus allowing the pants to last longer.

Referring to FIGS. 1, 2, 3, and 4 the convertible vest/coat of the apparel system of the present invention is seen. The vest/coat 42 includes a back panel 44, left front panel 46, and right front panel 48. The front panels 46 and 48 are attached to the back panel 44 at the tops of the shoulders and along seams extending along the sides of the vest 42. The seams extending along the sides of vest 42 are held together using leather laces 54 and deer antler buttons 56. The laces 54 allow the size of the vest to be adjusted and add to the natural look of the vest. Left front panel 46 in cooperation with back panel 44 form left arm hole 50. Right front panel 48 in cooperation with back panel 44 form right arm hole 52. Arm holes 50 and 52 are zippered, allowing left and right sleeves 58 and 60 to be releasably attached to the arm holes 50 and 52. With sleeves 58 and 60 removed, outer garment 42 functions as a vest. With sleeves 58 and 60 attached, outer garment 42 functions as a coat. The cuffs on sleeves 58 and 60 lace up with leather laces 62 and deer antler buttons 64 in a manner similar to the side seams in vest 42.

At the top of the front right panel a pocket 66 for carrying binoculars is provided. Pocket 66 has a VELCRO® fastenable flap for weather protection. Just to the above right of pocket 66 is a D-ring 68 for tying the binocular strap thereto. This practice prevents the binoculars from being lost, and also allows the hunter to drop the binoculars in a hurry in order to free his or her hands for shooting.

An elastic strip 70 is sewn on the upper left front panel 46. Transverse stitching form loops in the elastic strip 70 which are used for holding animal calls. With call holder 70 sewn on, at a slant, the calls held in call holder 70 are appropriately positioned to allow the calls to be used without having to be removed from the holder 70. This arrangement allows the hunter to call in game animals while holding his or her rifle at the ready, thus allowing the hunter to react to the appearance of a game animal and shoot.

Often when hunting, game animals such as deer, elk, or coyote are encountered as they are running away from the hunter. At such times using a call can stop the animal, but heretofore it has been difficult for the hunter to hold the call to his or her mouth while remaining ready to shoot. The call holder 70 leaves the hunters hands free to have full control of his or her firearm while using a call. A D-ring 72 on the upper left front panel 46 can be used to attach the call straps, preventing loss.

Below the call holder 70, another elastic strip with transverse stitching is provided. This strip is similar in structure to call holder 70 and is not shown in detail. The transverse stitching in this strip forms loops designed to hold rifle cartridges, thus forming a rifle cartridge holder generally referenced by the numeral 74. Cartridge holder 74 is provided with a flap for weather protection. Below cartridge holder 74 is a shot gun shell holder 76. The shell holder 76 is structurally identical to cartridge holder 74, except that the loops of the shell holder are larger in order to accommodate shot gun shells. Shell holder 76 also has a flap for weather protection.

There is a large utility pocket 78 on the lower portion of the left front panel 46. Pocket 78 has a VELCRO® fastenable flap for weather protection. A small utility pocket 80, also with a VELCRO® fastenable closure, is provided to the left of pocket 78 for small items such as a compass.

On the right front panel 48, below the binocular pocket 66, is a knife pocket 82. Knife pocket 82 is designed to accommodate the sheathed blade of a hunting knife for example. When the blade of the knife is held within pocket 82, the knife's handle will protrude from the knife pocket 82. A VELCRO® strap 84 is sewn to the right front panel 48 above the knife pocket 82. Strap 84 can be fastened around the knife handle to secure the knife in place within the knife pocket 82.

Also on the right front 48 of the vest, an elongated pocket 86 with a long VELCRO® fastenable flap or closure is provided. The pocket 86 can be used for storing longer items such as maps, water jug, or a rifle bi-pod.

Two large pockets 88 and 90 are provided on the front of vest 42. These open-top pockets allow the hunter to free his hands at a moment's notice by dropping anything he may be holding, such as shells, cartridges, candy wrappers, etc., into pockets 88 and 90, thereby allowing him or her to take control of his or her firearm. Shoe rivets 92 in the bottoms of these pockets allow rain water to drain out of pockets 88 and 90.

The neck opening of the vest/coat 42, formed cooperatively by back panel 44, left panel 46, and right panel 48, is provided with a fold-down collar 104. Zipper 94 allows the closure of the front of the vest 42.

A piece, the size and shape of the outline of a backpack, is cut out of the back panel 44. This piece, also referred to as the closure panel 96, carries the first halves of the teeth of three sets of zippers along its perimeter. The first half of the teeth of the first zipper 98 are provided on the bottom of the panel 96. These teeth matingly engage teeth provided on the bottom of the opening in the back panel 44. Depending on the orientation in which the zipper 98 is sewed on the bottom of the opening in the back panel 44 and on the bottom of the panel 96, the slide of the first zipper 98 will move either from right to left or from left to right to fix the bottom of the panel 96 to the bottom of the opening in the back panel 44.

The first half of the teeth of the second zipper 100 are provided along the right side and the right half of the top of the panel 96. These teeth matingly engage teeth provided on the right side and the right half of the top of the opening in back panel 44. Zipper 100 is sewed on such that the bottom stop of the zipper is located at the lower right corner of the opening in the back panel 44, and the top stop of the zipper 100 is located near the middle of the top of the opening in the back panel 44. The slide of the second zipper 100 will move from the lower right corner of the opening in the back panel 44 to about the middle of the top of the opening in the back panel 44, to fix the right side and the right half of the top of the panel 96 to the right side of the opening in the back panel 44 and the right half of the top of the opening in the back panel 44, respectively.

The first half of the teeth of the third zipper 102 are provided along the left side and the left half of the top of the panel 96. These teeth matingly engage teeth provided on the left side and the left half of the top of the opening in back panel 44. Zipper 102 is sewed on such that the bottom stop of the zipper is located at the lower left corner of the opening in the back panel 44, and the top stop of the zipper 102 is located near the middle of the top of the opening in the back panel 44. The slide of the third zipper 102 will move from the lower left corner of the opening in the back panel 44 to about the middle of the top of the opening in the back panel 44, to fix the left side and the left half of the top of the panel 96 to the left side of the opening in the back panel 44 and the left half of the top of the opening in the back panel 44, respectively. Naturally, zippers 98, 100, and 102 allow panel 96 to be releasably secured to the back panel 44 and act as a closure for the opening in the back panel 44.

A flap 106 is sewn under collar 104 at one end, and projects out from under the collar. The flap 106 is intended to cover the opening remaining at the location where the slides of zippers 100 and 102 come together, thereby preventing rain water from getting into the vest 42 through this opening. Hook-and-loop fastener 108, also referred to as VELCRO®, secures flap 106 over the opening.

Figure 12:
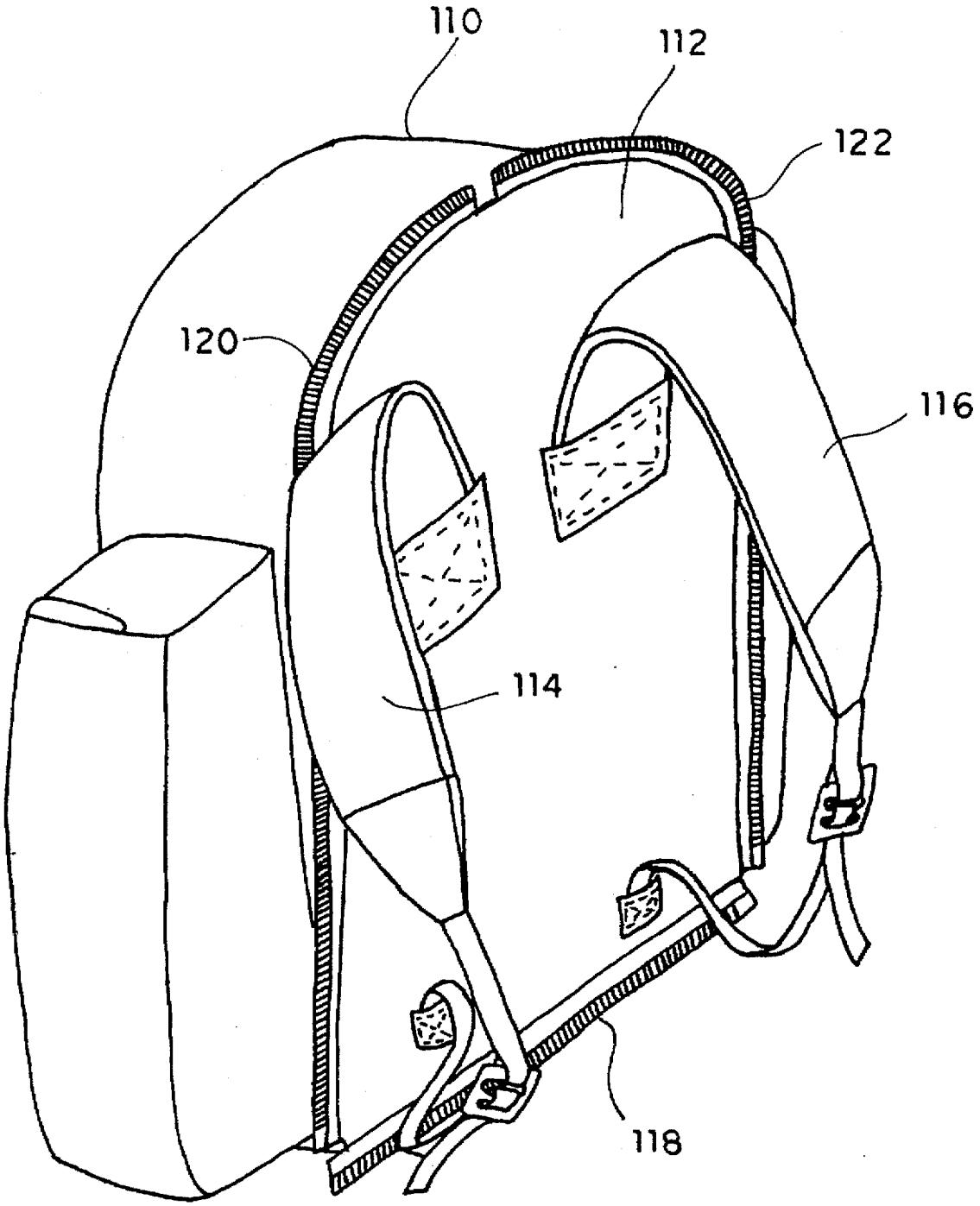
FIG. 12 is a perspective view of the backpack of the present invention showing the zipper teeth sewn around the perimeter of the back panel of the backpack.
Figure 13:
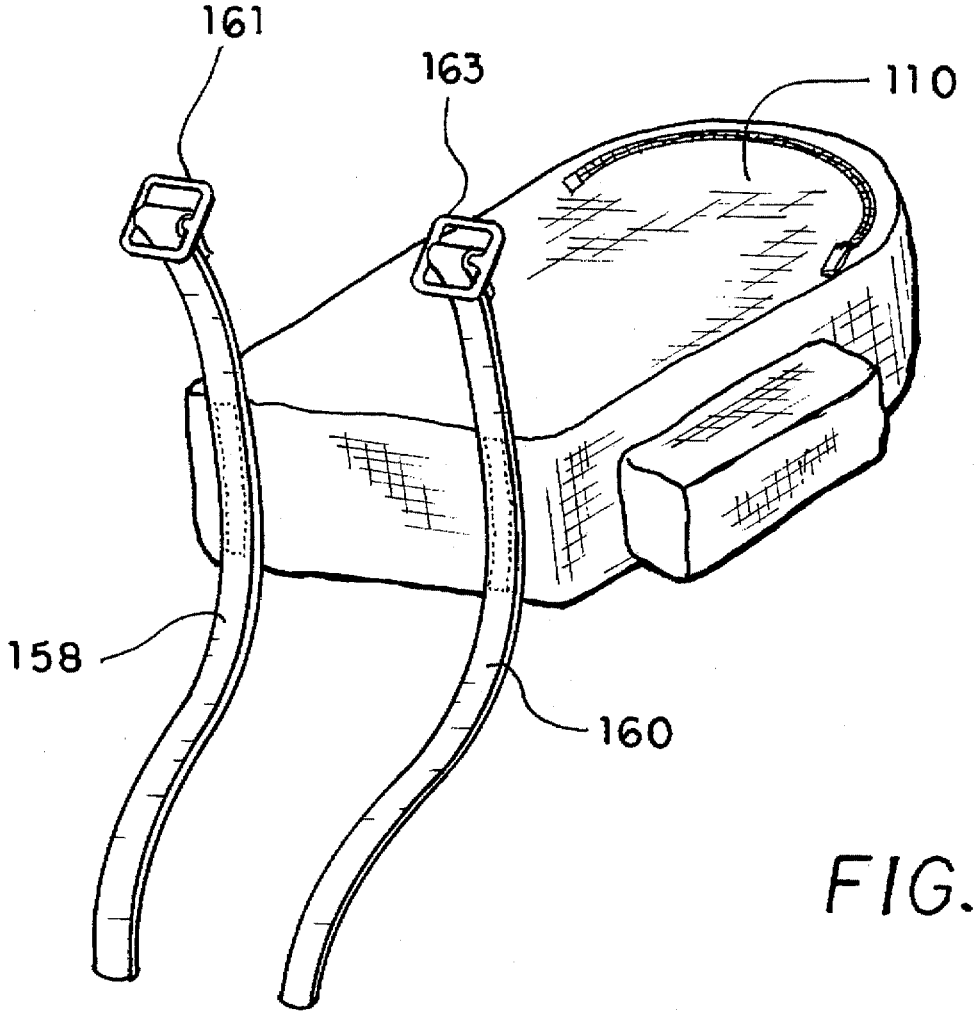
FIG. 13 is a bottom perspective view of the backpack of the present invention.

Referring to FIGS. 1, 12, and 13 the backpack of the present invention can be seen. The backpack 110 is conventional in design and has a back 112 from which shoulder harness straps 114 and 116 project. The backpack 110 differs from conventional backpacks in that it has three sets of zipper teeth 118, 120, and 122 sewn around the perimeter of the back 112 thereof. These sets of zipper teeth are identical to those sewn around the closure panel 96, and mate with zipper teeth provided along the perimeter of the opening in the back panel 44 to form zippers 98, 100, and 102, respectively. Thus backpack 110 can be releasably attached to vest 42, and acts as a closure for the opening in the back panel 44.

With the backpack attached to the back of vest 42, the vest and the backpack can be worn with the straps 114 and 116 passing under the front of the vest 42. This feature allows the wearer to freely access the pockets and holders on the front of the vest 42 while wearing backpack 110. The backpack and vest system allow the hunter to hike into an area with all the necessary supplies, including sleeping bag, tent, and all the necessary hunting items. The hunter can then disconnect the backpack, set up a camp, and still have every needed item in the vest to hunt the area surrounding his or her camp.

Attached to the lower back panel 44 is a game bag 124, which doubles as a seat for still hunting when extended. The game bag 124 easily folds up and out of the way when not in use. Zippered opening 126 allows access to the interior of the game bag 124. The hook-and-loop fastener 128 allows the game bag 124 to be secured in place, when the game bag 124 is in the retracted position.

Figure 3:
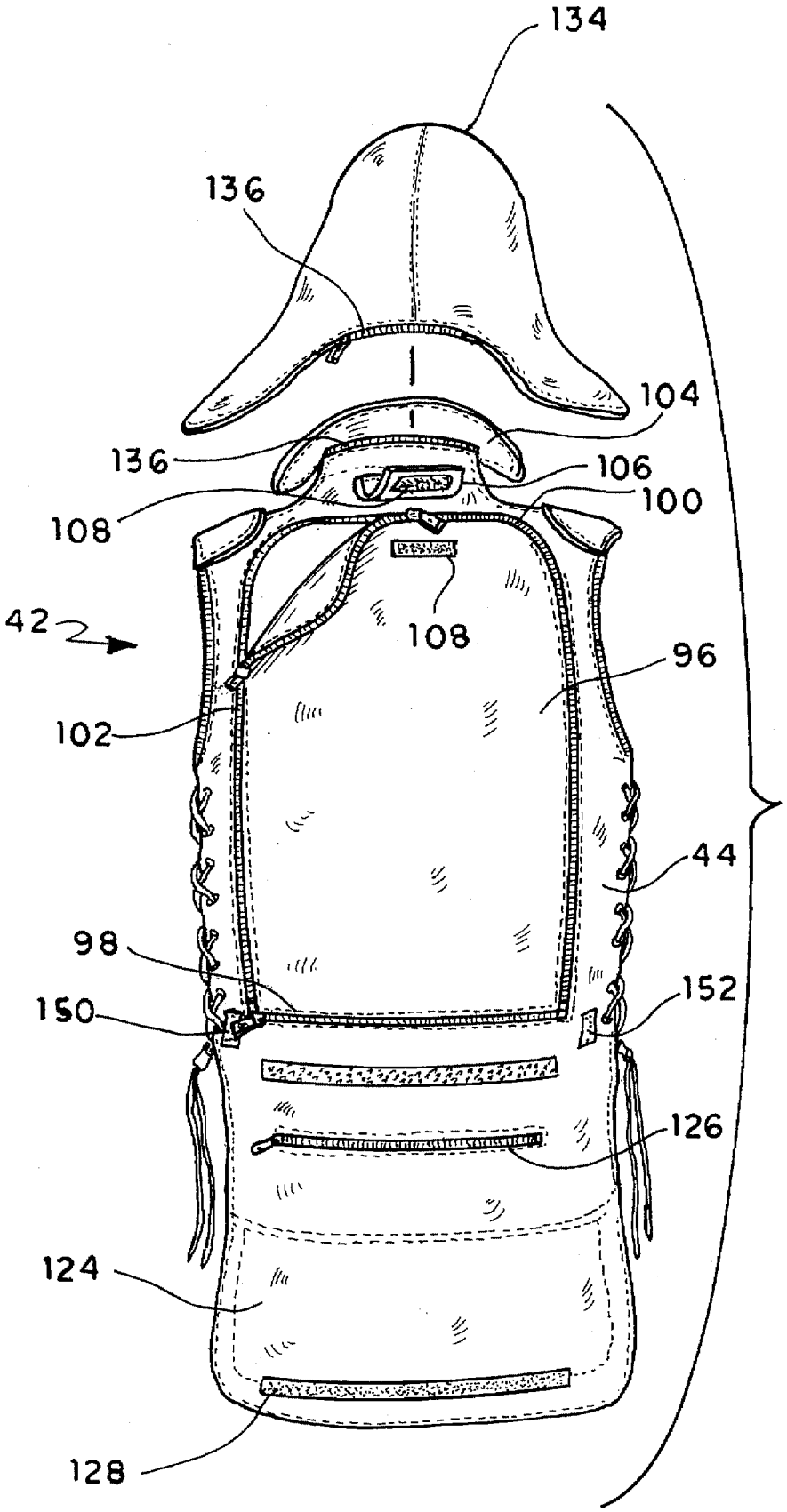
FIG. 3 is a rear view of the vest of the present invention showing the game bag deployed, and the detachable back panel and hood.
Figure 4:
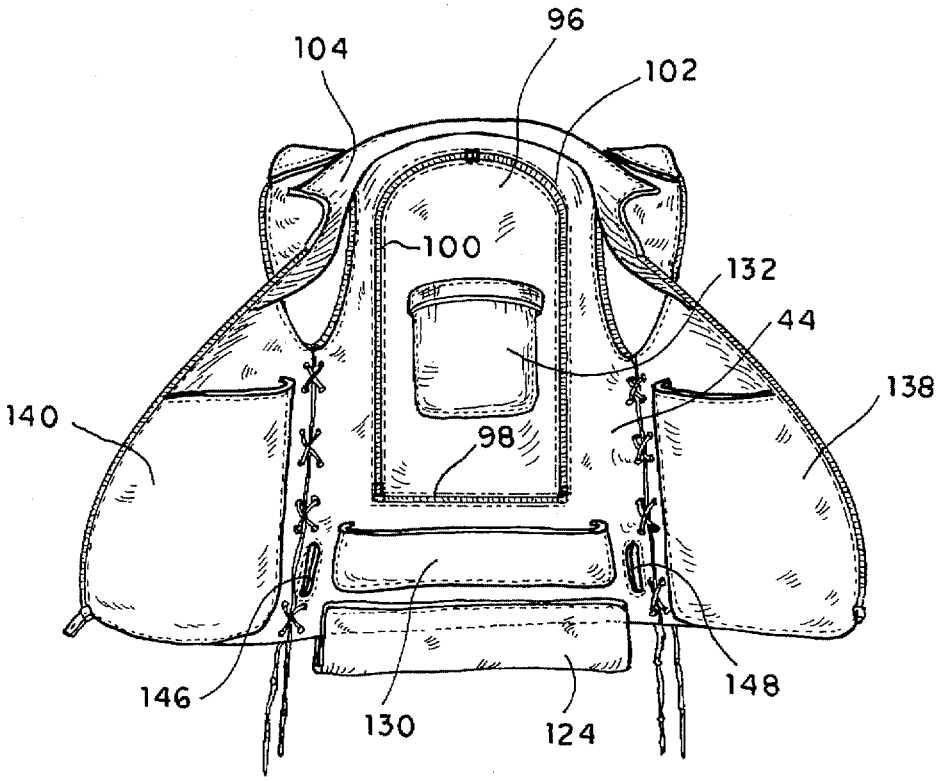
FIG. 4 is a front view of the vest of the present invention with the front panels spread apart to reveal details of the inside of the vest.

The piece 96 can be stored in a long, narrow pocket 130 provided on the inside of back 44 of the vest 42, just above the game bag 124 as shown in FIG. 4. The piece 96 has a pocket 132 on the inside thereof, for storing the hood 134 when the hood 134 is not in use. The hood 134 attaches to the vest 42 underneath the collar 104 using zipper 136 as shown in FIG. 3, allowing rain water to run off freely.

The sleeves 58 and 60 (FIG. 2) can be stored inside the vest, in the large utility pockets 138 and 140 (FIG. 4). Flaps 142 and 144 (FIG. 2) are attached to sleeves 58 and 60, respectively, at the armpit region of the sleeves. When sleeves 58 and 60 are attached to the vest 42, the flaps 142 and 144 extend into the vest 42, covering the small openings remaining in each armpit, where the ends of each zipper fastening sleeves 58 and 60 to arm holes 50 and 52 meet.

On each side of the game bag 124, reinforced slits 146 and 148 (FIG. 4) are provided. Flaps 150 and 152 (FIG. 3) cover slits 146 and 148 on the outside of the vest 42, preventing moisture from entering the vest through the slits 146 and 148. The slits 146 and 148 are provided to allow the belt of the fanny pack 154 to pass to the inside of the vest 42 where it is fastened about the wearer's waist, thus preventing the belt of the fanny pack from interfering with access to the front of the vest 42.

Referring to FIGS. 1, 6, 7, and 11, fanny pack 154 and the one man shelter 156 can be seen. The fanny pack 154 can be used to store a variety of items needed by the wearer, however its main function is to store the one-man shelter 156. In addition, when wearing the fanny pack at the same time as the backpack 110, the fanny pack helps to support the weight of the backpack, redistributing some of that weight to the wearer's waist through the fanny pack belt. Most preferably, backpack 110 has two straps 158 and 160 (see FIG. 13) provided at its bottom. Straps 158 and 160 can be sewn to the bottom of backpack 110 or they can be passed through belt loops provided at the bottom of backpack 110. Straps 158 and 160 are provided with buckles 161 and 163, allowing straps 158 and 160 to be tied around fanny pack 154 in the manner shown in FIG. 1 in order to secure the fanny pack and backpack together. Securing the fanny pack and backpack together ensures that some of the weight of the backpack is borne by the fanny pack at all times. This arrangement helps to reduce muscle strain and fatigue in the wearer's shoulders during long hikes.

The design of the fanny pack 154 allows rain water to run off the fanny pack without getting its contents wet. There is a zippered pocket 162 in the front on the outside of the fanny pack 154. Flap 164 acts as the closure for fanny pack 154. A zippered pocket 166 is provided on the outside of flap 164. The fanny pack 154 has two inside pockets 168 and 170. There are two zippered pockets 172 and 174 provided on the inside of the flap 164. The flap 164 is secured with a one inch nylon belt 176, and a one inch plastic slip buckle 178. The belt 180 for carrying the fanny pack 154 is made of two inch nylon web material. Elastic shell holder 182 provides for extra shell storage. The fanny pack belt buckle 184 is made of plastic and is of the type having resilient prongs which are engageable with a housing. The housing has finger cutouts that allow the prongs to be squeezed out of engagement with the housing, thereby allowing the buckle to be pulled apart. This type of buckle is normally referred to as a squeeze buckle. As was mentioned previously, the belt 180 is passed through slits 146 and 148 so that the belt 180 can be fastened about the wearer's waist on the inside of the vest 42, to thereby prevent the belt of the fanny pack from interfering with access to the front of the vest 42.

Often times when hunting, a hunter must spend long periods of time scanning the terrain with his or her binoculars, from a high vantage point. Such high vantage points tend to be windy and cold. For this reason the one-man shelter 156 was provided. This shelter is made of lightweight camouflage plastic material, and can be folded into a small volume allowing the shelter to be stored in fanny pack 154. The shelter 156 is three feet wide by three feet long and three feet high, with collapsible poles 186 and **186*a*, four three foot long, one eighth inch pieces of nylon rope 188, and four small stakes 190. The front pole 186*a*** can be removed completely for better visibility, or the front pole can be erected on an elevated surface such as a small stump or log to cause the roof of the shelter to be sloped, which allows for water to run off.

Figure 9A:
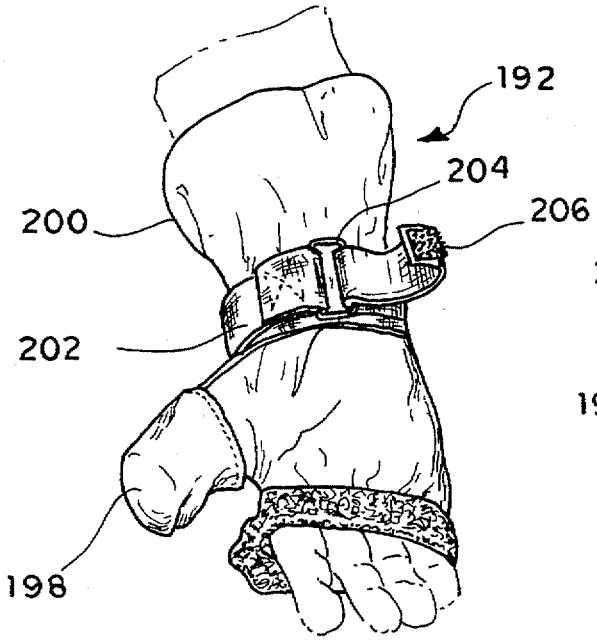
FIG. 9A is an environmental perspective of the right hand mitten of the present invention with the finger cover opened.
Figure 9B:
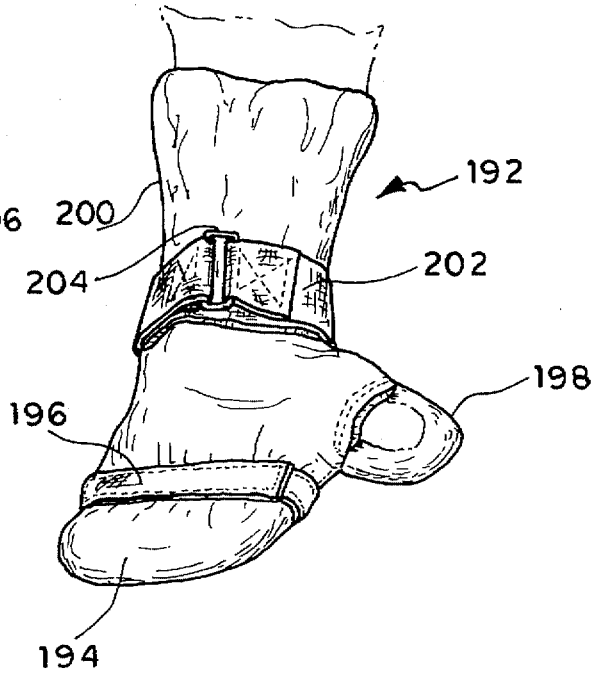
FIG. 9B is an environmental perspective of the left hand mitten of the present invention with the thumb cover opened.

Referring to FIGS. 9A and 9B, the mittens 192 are designed such that all fingers and the thumb could be exposed without taking the mittens off. This feature allows the wearer to manipulate objects such as ammunition or the wearer's firearm without having to take off the mittens. The finger portions 194 of the mittens 192 are attached to the rest of the mittens at the back-hand side of the mittens, the finger portions being open on the palm side of the mittens. This arrangement allows the finger portions 194 to fold back exposing the fingers of the wearer. Hook-and-loop fasteners 196 provided at the open side of finger portions 194 allow the finger portions to be secured in place when the fingers are reinserted in the finger portions.

Similarly, thumb portions 198 of the mittens 192 are attached to the rest of the mittens at the back-hand side of the mittens, the thumb portions being open on the palm side of the mittens. This arrangement allows the thumb portions 198 to fold back exposing the thumbs of the wearer. When the fine manipulative tasks of the wearer are completed, the wearer's thumbs can be reinserted in the thumb portions to protect them from the elements.

Optionally, mating portions of a VELCRO® fastener can be provided on the backside of each of the mittens 192, one portion being provided on the back of the finger portion and the complementary portion being provided on the back of the mitten near the wrist area. These VELCRO® fasteners allow the finger portions 194 to be secured in the open position after they are folded back to expose the wearer's fingers. These fasteners can also be used to hold the mittens together when they are not in use. The portions 200 of the mittens that extend from the wrists along the forearm, completely enclose the cuffs of the sleeves 58 and 60. Portions 200 can be tightened down around the cuffs with two inch nylon straps 202. Straps 202 are wrapped around the wrists, passed through D-rings 204 and drawn tightly therethrough, folded back on themselves, and secured in place by VELCRO® fasteners 206, thus sealing the mittens and the sleeves from the elements.

Figure 8:
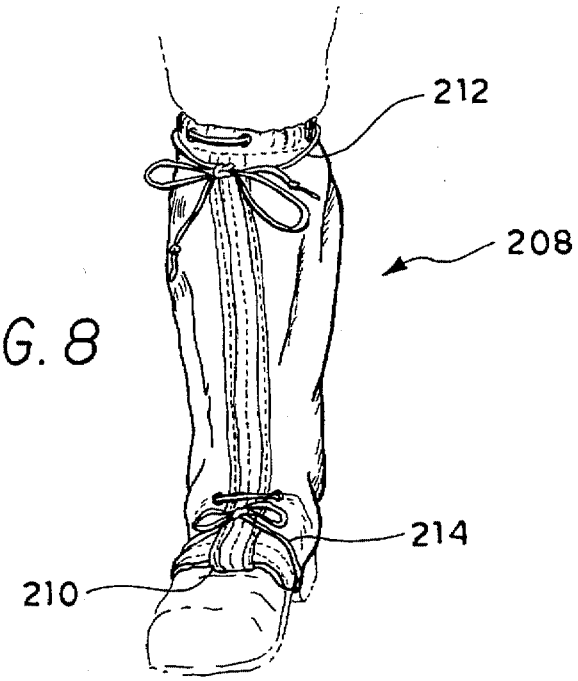
FIG. 8 is an environmental perspective of the gaiters of the present invention.

Referring to FIGS. 1 and 8, gaiters 208 can be seen. Gaiters 208 provide protection for the lower legs, between the knee and the foot. The bottom of gaiters 208 has extensions 210 which partially cover the top of the foot. The top and bottom of the gaiters are provided with drawstrings 212 and 214, respectively, which allow the gaiters to be gathered snugly about the lower legs. The bottom drawstring 214 can be wrapped around the foot and then tied to prevent the gaiters from sliding up along the lower leg.

Figure 10:
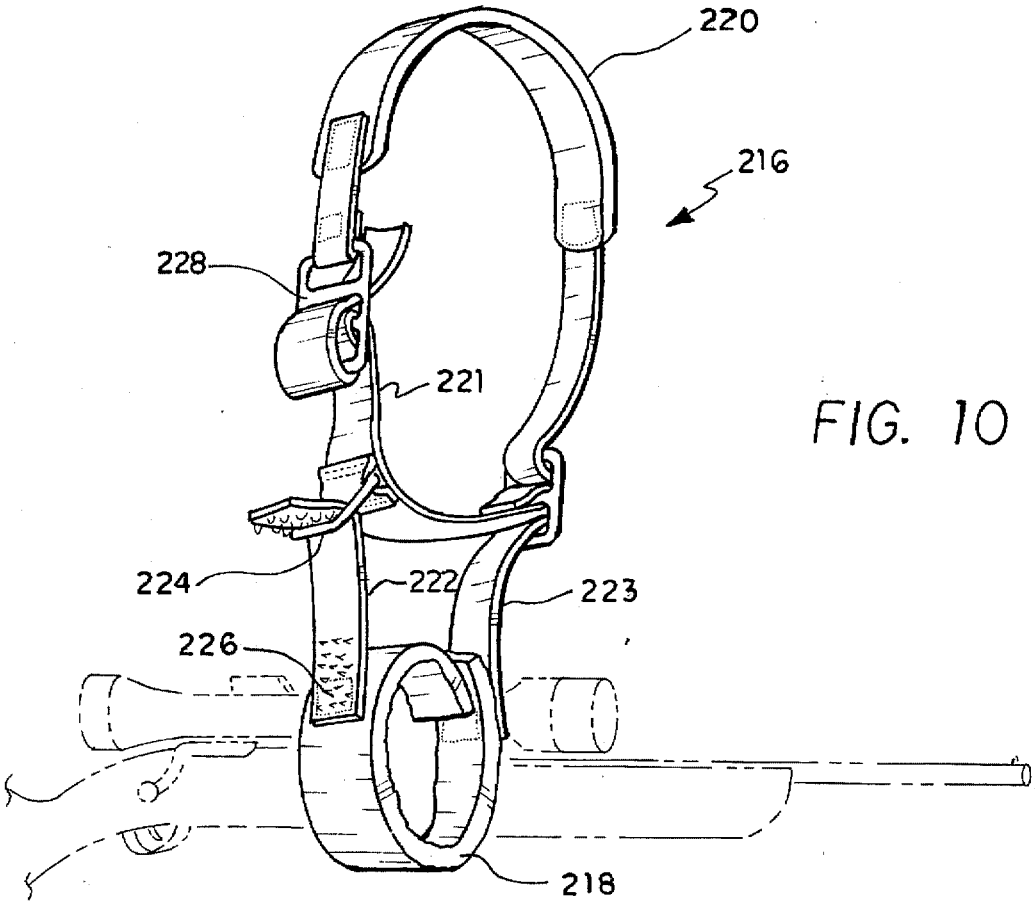
FIG. 10 is an environmental perspective of the rifle sling of the present invention.
Figure 11:
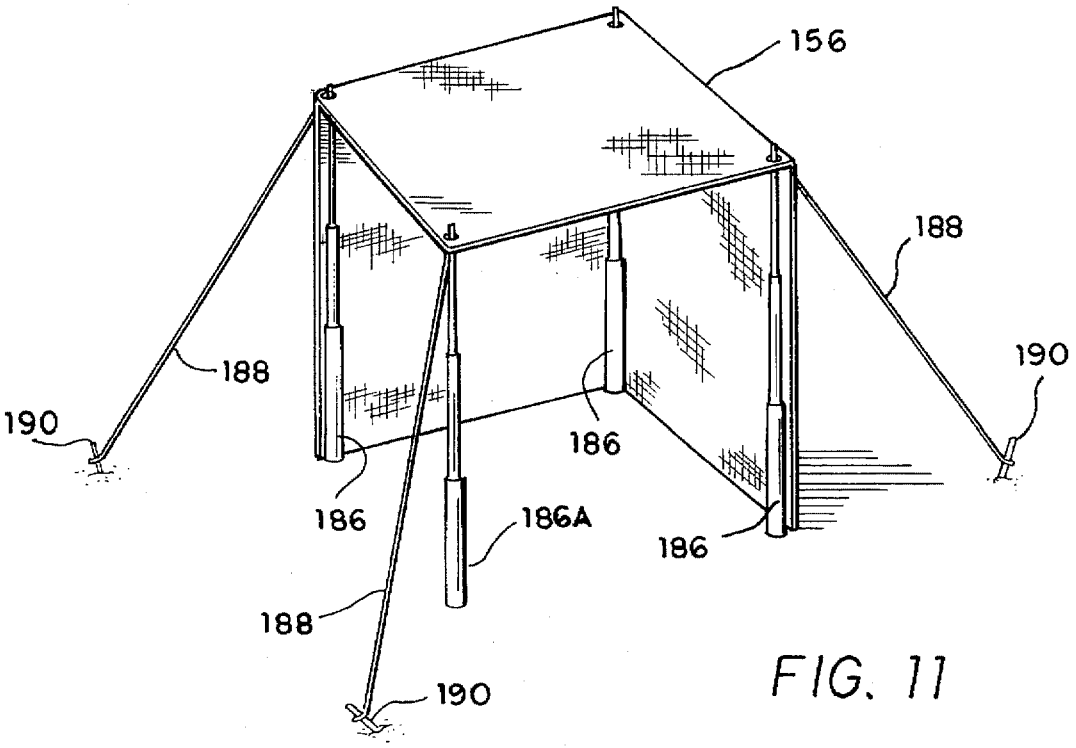
FIG. 11 is an environmental perspective of the one man shelter of the present invention.

Referring to FIG. 10 the gun sling forming part of the apparel system of the present invention is seen. The gun sling 216 includes a padded portion 218 which wraps around the firearm. Shoulder strap 220 passes about the neck and one shoulder of the wearer to suspend the firearm from the wearer in a substantially horizontal direction. Strap 220 forms a closed loop in cooperation with strap 221. A free end 223 of strap 220 is attached to the padded portion 218. Strap 221 supports a D-ring 224. Once the padded portion 218 is wrapped around the firearm, a strap 222 can be used to secure the padded portion 218 in the wrapped configuration. The strap 222, which is sewn to the back of the padded portion 218, passes through D-ring 224 and is secured back on itself using the VELCRO® fastener 226. Buckle 228 allows the length of the loop formed by the shoulder strap 220 and the strap 221, to be adjusted to any desired length.

The apparel of the present invention gives a high level of protection from the weather, branches, thistles, brush, insects, bushes, snakebite, etc., while at the same time providing excellent freedom of movement to the wearer. This freedom of movement is due at least in part to the segmented nature of the apparel of the present invention. The gaiters begin at the foot and end at the knee, the chinks begin at the knee and end at the waist, and the vest/coat begins at the waist and ends at the neck. Because each item of the apparel system begins and ends at a joint, the movement of the joints of the wearer's body are not impaired.

The modular construction of the apparel system of the present invention allows the apparel system to be adapted to any outdoor situation, from short walks around the cabin or camp site to long treks where the wearer must be prepared for any emergency or weather change.

The apparel system of the present invention is preferably made of 12 oz. waterproof, mildewproof canvas. This type of material is easy to maintain. Cleaning can be accomplished by directing a water hose at the apparel, and then allowing the apparel to air dry. Optionally, a medium bristle, dry brush can be used to brush off dried mud and/or other adhering soil from the apparel before directing a water hose thereto.

All apparel items were sewn together with White nylon thread, then glued, with tear mender fabric cement, around all seams, zippers and straps. All stress points have been double stitched and reinforced with pieces of material when necessary.

It is to be understood that the present invention is not limited to the sole embodiment described above, but encompasses any and all embodiments within the scope of the following claims.

I claim:

1. An apparel system comprising:

an upper body outer wear having a left front panel, a right front panel, and a back panel, said back panel having an opening dimensioned and configured to fit around a backpack, the backpack acting as a closure for said opening when said upper body outer wear is worn with the backpack; and a closure panel dimensioned and configured to fit said opening and to act as a closure therefor when said upper body outer wear is not being worn with a backpack.

2. The apparel system according to claim 1, wherein said opening is defined by a rim, said rim having first zipper teeth provided along at least a portion thereof, said closure panel having a perimeter, and said perimeter being provided with second zipper teeth matingly engageable with said first zipper teeth, whereby said closure panel is releasably attachable to said rim of said opening.

3. The apparel system according to claim 2, wherein said rim is provided with said first zipper teeth along substantially its entirety.

4. The apparel system according to claim 3, further including:

a backpack having a back, said back of said backpack having third zipper teeth provided about its periphery, said third zipper teeth being matingly engageable with said first zipper teeth, whereby said backpack is releasably attachable to said rim of said opening.

5. The apparel system according to claim 4, wherein said upper body outer wear has sleeves which are releasably attached to armholes, cooperatively formed by said left front panel, said right front panel, and said back panel, using zippers.

6. The apparel system according to claim 5, further including:

a game bag provided at a lower portion of said back panel, said game bag being movable between a retracted and an extended position; and a hook-and-loop fastener having a first portion thereof attached to said back panel, said hook-and-loop fastener releasably securing said game bag in said retracted position.

7. The apparel system according to claim 6, wherein said upper body outer wear has a front formed collectively from said left front panel and said right front panel, and said apparel system further includes a plurality of pockets distributed on said front of said upper body outer wear.

8. The apparel system according to claim 7, wherein said upper body outer wear has a collar, and said apparel system further includes a hood releasably attachable to said back panel in proximity to said collar.

9. The apparel system according to claim 1, wherein said upper body outer wear has sleeves which are releasably attached to armholes, cooperatively formed by said left front panel, said right front panel, and said back panel, using zippers.

10. The apparel system according to claim 9, further including:

a game bag provided at a lower portion of said back panel, said game bag being movable between a retracted and an extended position; and a hook-and-loop fastener having a first portion thereof attached to said back panel, said hook-and-loop fastener releasably securing said game bag in said retracted position.

11. The apparel system according to claim 10, wherein said upper body outer wear has a front formed collectively from said left front panel and said right front panel, and said apparel system further includes a plurality of pockets distributed on said front of said upper body outer wear.

12. The apparel system according to claim 11, further including a fanny pack having a belt, and wherein said back panel has first and second slits to allow said belt to pass therethrough, whereby said belt can be fastened about a wearer's waist underneath said left front panel and said right front panel when the wearer is wearing both said fanny pack and said upper body outer wear.

13. The apparel system according to claim 1, further including a fanny pack having a belt, and wherein said back panel has first and second slits to allow said belt to pass therethrough, whereby said belt can be fastened about a wearer's waist underneath said left front panel and said right front panel when the wearer is wearing both said fanny pack and said upper body outer wear.

* * * * *